United States Patent [19]

Mattei et al.

[11] Patent Number: 4,693,359

[45] Date of Patent: Sep. 15, 1987

[54] DEVICE FOR TRANSFERRING BAR-SHAPED ARTICLES

[75] Inventors: Riccardo Mattei; Gastone Dall'Osso, both of Bologna, Italy

[73] Assignee: G.D Societa' per Azioni, Bologna, Italy

[21] Appl. No.: 799,326

[22] Filed: Nov. 18, 1985

[30] Foreign Application Priority Data

Dec. 6, 1984 [IT] Italy ..... 3647 A/84

[51] Int. Cl.[4] ..... B65G 29/00; A24C 5/00

[52] U.S. Cl. ..... 198/474.1; 131/281; 131/282; 198/377; 198/471.1; 198/803.5; 209/535

[58] Field of Search ..... 198/377, 471.1, 474.1, 198/803.5; 131/282, 281; 209/535, 536, 537, 701

[56] References Cited

U.S. PATENT DOCUMENTS

| | | | |
|---|---|---|---|
| 3,757,943 | 9/1973 | Chae et al. | 209/701 X |
| 4,506,779 | 3/1985 | Seragnoli | 198/471.1 X |
| 4,558,778 | 12/1985 | Cristiani | 198/471.1 |
| 4,565,202 | 1/1986 | Seragnoli et al. | 131/281 |

*Primary Examiner*—Jeffrey V. Nase

*Attorney, Agent, or Firm*—Marshall, O'Toole, Gerstein, Murray & Bicknell

[57] ABSTRACT

A transfer device in which the bar-shaped articles, in particular cigarettes, are transferred transversely to their axis by three rollers, of which one is disposed in an intermediate position between the other two and is tangential thereto at two separate points defining between them a transfer arc, and are made to advance along said transfer arc supported by respective cradles associated with a rotation device arranged to rotate the cradles about their axis at a constant angular speed equal to a whole multiple of the angular speed of the intermediate roller.

2 Claims, 3 Drawing Figures

DEVICE FOR TRANSFERRING BAR-SHAPED ARTICLES

BACKGROUND OF THE INVENTION

This invention relates to a device for transferring bar-shaped articles.

The invention finds particularly advantageous application in the production of smoking articles, in particular cigarettes, to which the description given hereinafter makes specific reference but without thereby limiting its general application.

During cigarette production, it is sometimes necessary to cause the cigarettes to undergo a tranverse translational movement and a simultaneous rotary movement about their axis for specific process manipulation purposes.

To cause the cigarettes to undergo roto-translational motion, it is known to use a transfer device in which the cigarettes to be manipulated are transferred from an inlet roller to a transfer roller disposed tangential to said inlet roller and provided along its outer periphery with a plurality of rotatable cradles. Each cradle is arranged to house a respective cigarette and to surrender it, on completion of transfer, to an outlet roller tangential to said transfer roller.

As each cradle passes through the positions in which it is tangential to the inlet and outlet rollers, it lies in a determined angular rest position relative to the transfer roller in order to facilitate correct cigarette transfer between the inlet, transfer and outlet rollers. While it traverses a central portion of its path of advancement between the two said points of tangency, each cradle is rotated firstly at increasing angular speed, then at constant angular speed, and then at decreasing angular speed. Each cigarette is manipulated as it advances along a manipulation arc, along which the relative cradle rotates about its axis at the said constant angular speed. In the aforesaid known transfer device, the cigarettes are subjected to considerable positive and negative angular acceleration as they advance along the transfer roller, and this can compromise their structural stability, at least causing tobacco to escape. Moreover, as a result of the need to angularly accelerate and then decelerate said cradles, the width of the manipulation arc is relatively small.

Finally, from the mechanical aspect, the aforesaid known transfer device has a relatively complicated structure due to the need to vary the angular speed with which the cradles rotate about their axis between zero and a determined constant value during each complete revolution of the transfer roller about its axis.

SUMMARY OF THE INVENTION

The object of the present invention is to provide a transfer device which is free from the aforesaid drawbacks.

Said object is attained according to the present invention by a device for transferring bar-shaped articles along a determined path and for subjecting said articles, at least along part of said path, to a translational movement transverse to their longitudinal axis and a simultaneous rotation about their axis; the device comprising a transfer roller, and an inlet roller and outlet roller which are rotatable in directions opposite that of said transfer roller and are tangential to this latter along a first and, respectively, a second generating line which define along the periphery of said transfer roller a transfer arc and a return arc which are conjugate to each other; a drive shaft coaxial to said transfer roller and angularly rigid therewith, and operating means for rotating said drive shaft at constant angular speed; a plurality of support elements for respective said articles, said support elements being uniformly distributed about said transfer roller and being coupled to this latter such that they each rotate relative to it about their respective longitudinal axis transverse to said path; and transmission means interposed between said drive shaft and said support elements to cause these latter to undergo said rotation about their respective said longitudinal axes; characterised in that said transmission means are such as to cause each said support element to make several complete revolutions at constant angular speed about its respective said longitudinal axis for one complete revolution of said support element about the axis of said drive shaft; said first and second generating lines of tangency being disposed such that the each of said transfer and return arcs is either equal to or is a respective whole multiple of a basic arc traversed by each said support element about the axis of said drive shaft during one complete revolution about its own said longitudinal axis.

BRIEF DESCRIPTION OF THE DRAWINGS

The invention is described hereinafter with reference to the accompanying drawings, which illustrate some non-limiting preferred embodiments thereof and in which.

DETAILED DESCRIPTION OF THE INVENTION

Figure 1:
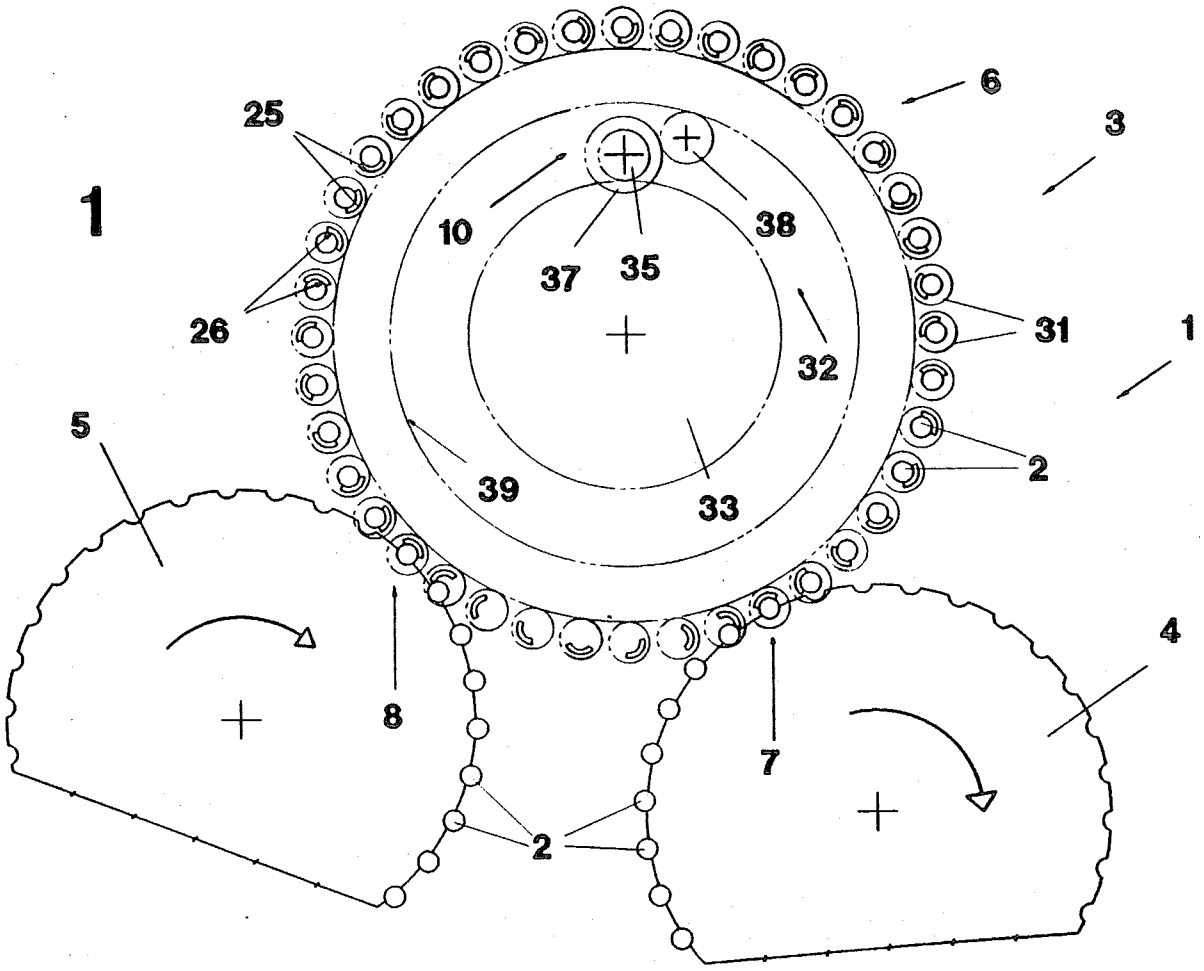
FIG. 1 is a diagrammatic illustration of a cigarette transfer device constructed in accordance with the present invention.

In FIG. 1, the reference numeral 1 indicates overall a transfer device which enables bar-shaped articles, for example cigarettes 2, to be advanced transversely and rotated about their axis in a cigarette manipulation machine 3.

The device 1 comprises an inlet roller 4 and an equirotating outlet roller 5, between which an intermediate roller 6 is disposed tangential to the rollers 4 and 5 at two separate points 7 and 8 of tangency. The points 7 and 8 define along the periphery of the roller 6 two mutually conjugate arcs, the first of which, extending between the points 7 and 8 in the direction of rotation of the roller 6, is known hereinafter as the "transfer arc", and the second of which is known hereinafter as the "return arc".

Figure 2:
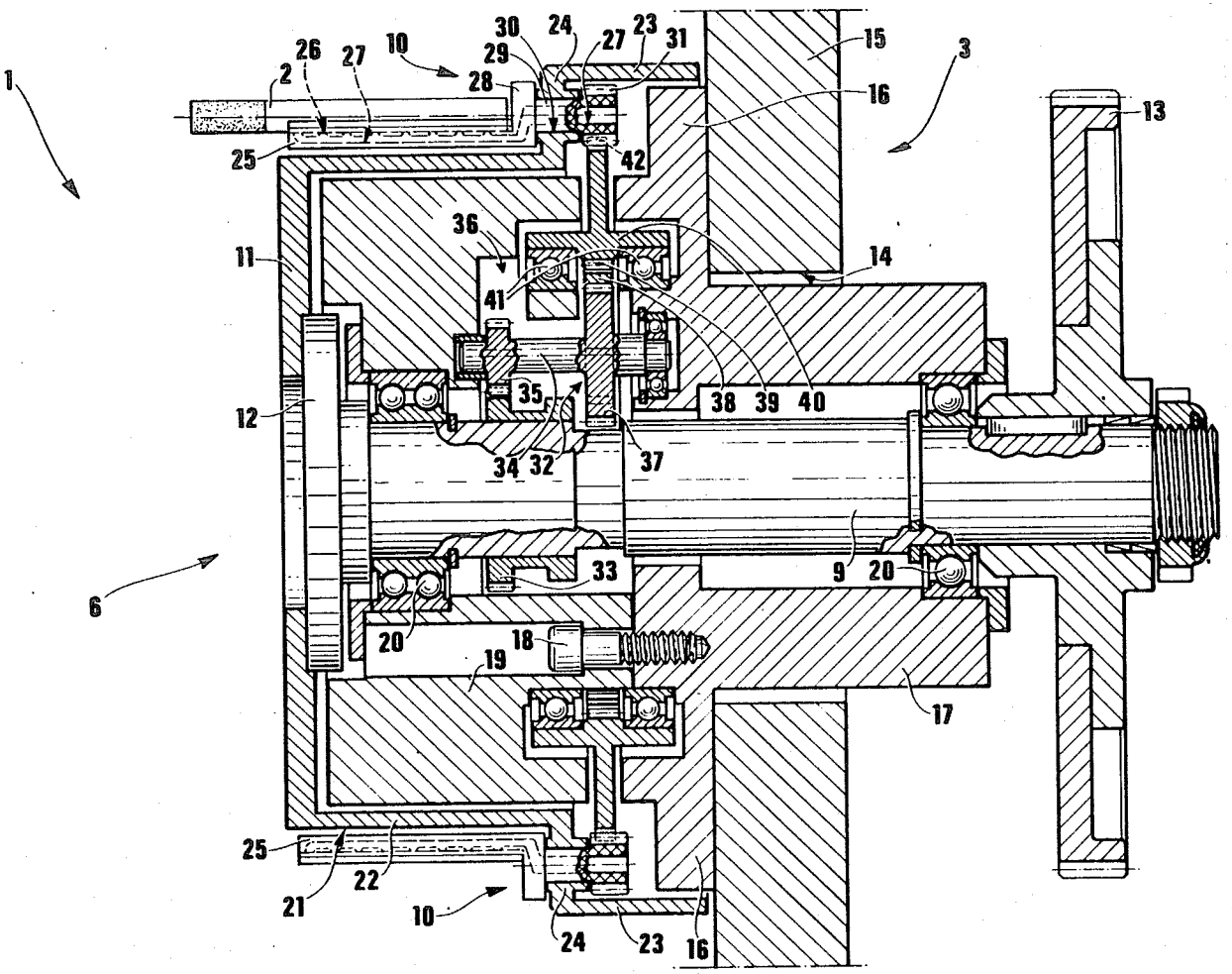
FIG. 2 is an axial section through a first embodiment of a detail of FIG. 1.

As shown in FIG. 2, the transfer device 1 also comprises a central drive shaft 9 supporting the roller 6, and a rotation device 10 arranged to rotate the cigarettes 2 at a determined constant angular speed about their axis during their translational movement caused by the rotation of the roller 6 about the axis of the shaft 9.

The roller 6 is provided with an inner annular end flange 11, the inner periphery of which is rigidly connected to the outer periphery of an annular end flange 12 of the shaft 9. The shaft 9 extends through the roller 6 and, at that end distant from the end connected to this latter, supports a toothed wheel 13 which is coupled in a manner not shown to a source of motion, not illustrated.

An intermediate portion of the shaft 9 extends through a hole 14 in a fixed wall 15 of the machine 3. To the outer surface of the wall 15 there is rigidly connected a flange 16 of a tubular member 17 which is coaxial to the shaft 9 and extends through the hole 14 towards the toothed wheel 13. By means of a plurality of axial screws 18, of which only one is shown in FIG. 2, a further tubular member 19 is rigidly connected to the outer surface of the flange 16 in a manner coaxial to the tubular member 17, and together with this latter rotatably supports the shaft 9 by way of two bearings 20, of which the first is engaged in the member 17 and the second engaged in the member 19.

The roller 6 comprises a lateral wall 21 extending from the outer periphery of the flange 11 to the wall 15, and consists of a first cylindrical portion 22 disposed external to the member 19, a second cylindrical portion 23 of diameter greater than the first and extending external to the flange 16, and an intermediate flat annular portion 24 connecting together the facing ends of the cylindrical portions 22 and 23 and extending in a plane normal to the axis of the roller 6.

The rotation device 10 comprises a plurality of support elements in the form of cradles 25 uniformly distributed about the outer surface of the portion 22 and each provided with a longitudinal groove 26 defining a seat for a respective cigarette 2, which is retained within the relative groove 26 by suction through a conduit 27 connected to a suction device, not shown.

The cradles 25 extend parallel to the axis of the roller 6, and are each provided, at their end facing the wall 15, with a head 28 from which an axial pin 29 extends, rotatably mounted through a respective bore 30 formed through the portion 24 of the wall 21.

On that end of each pin 29 which lies on the inside of the wall 21 there is keyed a toothed wheel 31 driven by transmission means comprising an epicyclic gear train 32, of which the sun gear, indicated by 33, is keyed on to the shaft 9. The gear train 32 comprises a planet gear 34, which is rotatably supported at its ends by the cylindrical members 17 and 19 constituting a fixed gear carrier, and is housed inside a cavity 36 defined between these latter. The planet gear 34 comprises a first toothed wheel 35 engaging with the sun gear 33, and a second toothed wheel 37 which, by way of an intermediate toothed wheel 38 supported within the cavity 36 in a manner not shown, is coupled to the inner toothing 39 of an external cylindrical ring gear 40 which is coaxial to the shaft 9 and is supported rotatably by the tubular members 17 and 19 by way of bearings 41. The ring gear 40 also comprises external toothing 42, which meshes with the toothed wheels 31 of all the pins 29. When in operation, the toothed wheel 13 and thus the shaft 9 and roller 6 are rotated at a generally constant angular speed, which is transmitted by the gear train 32 to the toothed wheels 31. Thus, as a result of the rotation of the toothed wheel 13, the cradles 25 undergo translational movement transversely to their longitudinal axes conveyed by the roller 6, and each rotates about its axis with a determined angular speed by virtue of the torque transmitted to it by the gear train 32.

With reference to FIG. 1, each cradle 25 is phased angularly relative to the roller 6 such that as this latter rotates, each cradle 25 on reaching the point of tangency 7 lies with the concavity of its groove 27 facing radially outwards so as to be able to receive a respective cigarette 2 from the inlet roller 4. The cigarettes 2 are transferred from the roller 4 into the grooves 27 of the relative cradles 25 by suction in known manner. Having received the respective cigarette 2, each cradle 25 proceeds from the point 7 to the point 8 along the transfer arc, translating transversely to its axis by the effect of the rotation of the roller 6 and rotating about itself relative to the roller 6. The transmission ratio of the gear train 32 is such that a determined whole number of complete revolutions of each cradle 25 about its axis corresponds to one complete revolution of the roller 6.

This is because each cradle 25 must be disposed with its groove 27 facing radially outwards not only at the point 7, but also at the point 8, in order to enable the relative cigarette 2 to be transferred from the roller 6 to the roller 5, and must then return to the same angular position when again passing through the point 7.

The number of said complete revolutions can in the limit be equal to two if, according to a non-illustrated modification, the transfer and return arcs are equal to each other, ie equal to 180°.

The gear train 32 must therefore be dimensioned such as to make each cradle 25 undergo at least one complete revolution about its axis as the cradle 25 passes through the transfer arc, and at least one further complete revolution as said cradle 25 passes through the return arc, and the transfer and return arcs must have lengths which are equal to, or a multiple of, an arc, known hereinafter as the "basic arc", which is traversed by each cradle 25 during one complete revolution about its axis.

Figure 3:
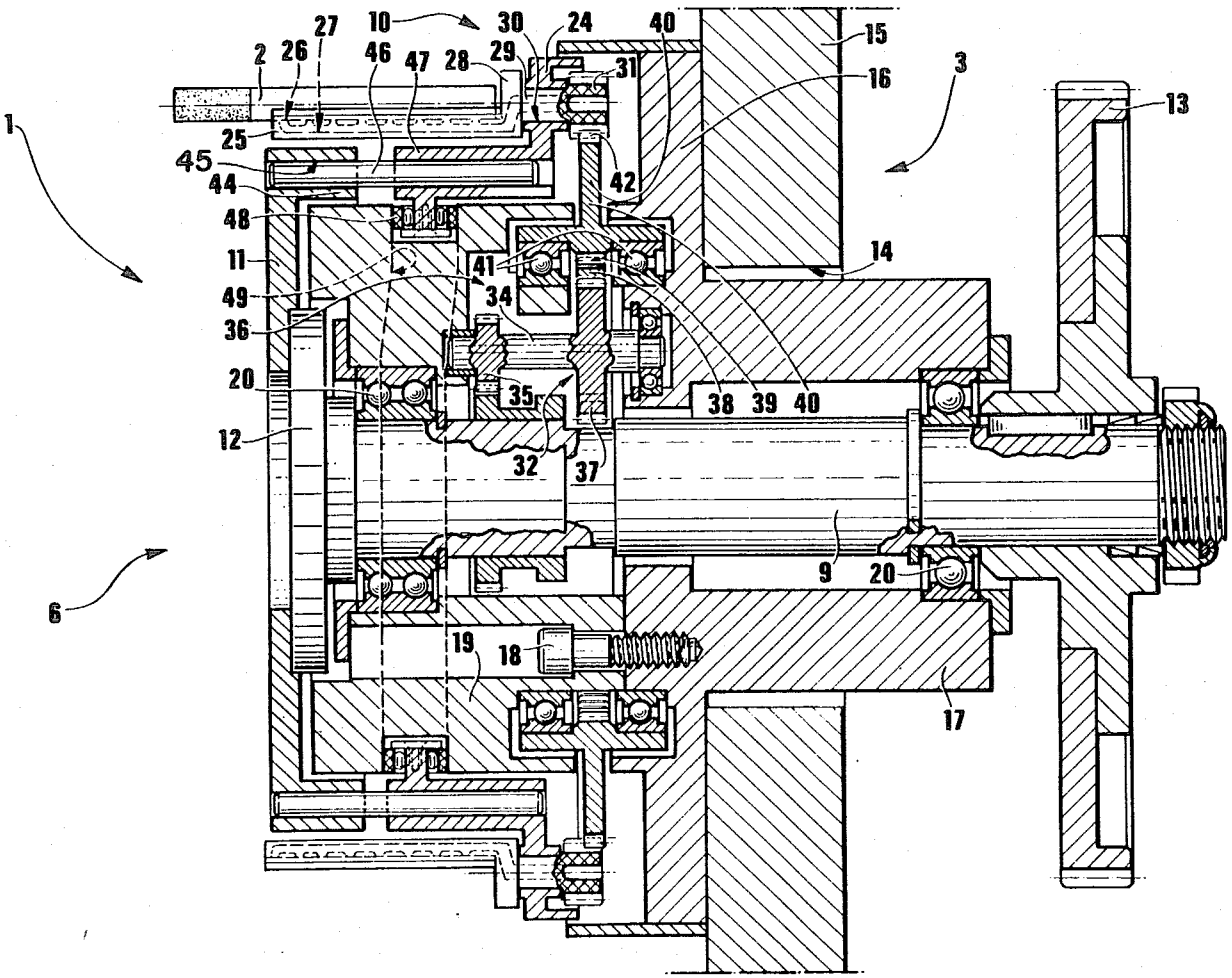
FIG. 3 is an axial section through a second embodiment of a detail of FIG. 1.

In the modification shown in FIG. 3, an annular ring 44 extending external to the member 19 is rigidly connected to the outer periphery of the flange 11, and comprises in correspondence with each cradle 25 an axial bore 45 in which there is fixed the end of a guide rod 46 for a slide 47 slidable between the ring 44 and ring gear 40, and rotatably supporting a relative pin 29. The toothed wheel 31 of this latter is in slidable engagement with the toothing 42 of the ring gear 40, and is of such a length as to always mesh with the toothing 42 whatever the axial position assumed by the slide 47. Each slide 47 carries connected to its inner surface a radial cam-following roller 48, which engages a pusher means constituted by a cam groove 49 provided in the outer surface of the member 19. When in operation, each cigarette 2 as it advances along the transfer arc undergoes a determined axial displacement relative to the roller 6.

We claim:

1. A device for transferring bar-shaped articles (2) along a determined path and for subjecting said articles (2), at least along part of said path, to a translational movement transverse to their longitudinal axis and a simultaneous rotation about their axis; the device (1) comprising a transfer roller (6), and an inlet roller (4) and outlet roller (5) which are rotatable in directions opposite that of said transfer roller (6) and are tangential to this latter along a first and, respectively, a second generating line of tangency which define along the periphery of said transfer roller (6) a transfer arc and a return arc which are conjugate to each other; said first and second generating lines of tangency being disposed such that the length of each of said transfer and return arcs is either equal to or is a respective whole multiple of a basic arc traversed by each said support element (25) about the axis of said drive shaft (9) during one complete revolution about its own said longitudinal axis; a drive shaft (9) coaxial to said transfer roller (6) and angularly rigid therewith, and operating means for rotating said drive shaft at constant angular speed; a plurality of support elements (25) for respective said articles (2), said support elements (25) being uniformly distributed about said transfer roller (6) and being coupled to this latter such that they each rotate relative to it about their respective longitudinal axis transverse to said path; and transmission means (32) interposed between said drive shaft (9) and said support elements (25) to cause these latter to undero said rotation about their respective said longitudinal axes; characterized in that said transmission means (32) are such as to cause each said support element (25) to make several complete revolutions at constant angular speed about its respective said longitudinal axis for one complete revolution of the same support element (25) about the axis of said drive shaft (9); said transmission means (32) comprising a sun gear (33) keyed on to said drive shaft (9), a fixed gear carrier (17,19), and an outer ring gear (40) coaxial to said drive shaft (9) and rotatable relative thereto; and each said support element (25) comprising a toothed wheel (31) coaxial to its said longitudinal axis and meshing with external toothing (42) coaxial to said drive shaft (9) and angularly rigid with said outer ring gear (40).

2. A device for transferring bar-shaped articles (2) along a determined path and for subjecting said articles (2), at least along part of said path, to a translational movement transverse to their longitudinal axis and a simultaneous rotation about their axis; the device (1) comprising a transfer roller (6), and an inlet roller (4) and outlet roller (5) which are rotatable in directions opposite that of said transfer roller (6) and are tangential to this latter along a first and, respectively, a second generating line of tangency which define along the periphery of said transfer roller (6) a transfer arc and a return arc which are conjugate to each other; said first and second generating lines of tangency being disposed such that the length of each of said transfer and return arcs is either equal to or is a respective whole multiple of a basic arc traversed by each said support element (25) about the axis of said drive shaft (9) during one complete revolution about its own said longitudinal axis; a drive shaft (9) coaxial to said transfer roller (6) and angularly rigid therewith, and operating means for rotating said drive shaft at constant angular speed; a plurality of support elements (25) for respective said articles (2), said support elements (25) being uniformly distributed about said transfer roller (6) and being coupled to this latter such that they each rotate relative to it about their respective longitudinal axis transverse to said path; and transmission means (32) interposed between said drive shaft (9) and said support elements (25) to cause these latter to undergo said rotation about their respective said longitudinal axes; characterized in that said transmission means (32) are such as to cause each said support element (25) to make several complete revolutions at constant angular speed about its respective said longitudinal axis for one complete revolution of the same support element (25) about the axis of said drive shaft (9); each said support element (25) comprising a pin (29) coaxial to the relative said longitudinal axis and coupled in a rotatable and axially slidable manner to said transfer roller (6); and pusher means (49) being carried by said transfer roller (6) to impress on said support element (25) axial to-and-fro movements in accordance with a predetermined relationship.

* * * * *